US009962046B2

(12) United States Patent
Rowntree

(10) Patent No.: US 9,962,046 B2
(45) Date of Patent: May 8, 2018

(54) VACUUM CLEANING APPLIANCE

(71) Applicant: BLACK & DECKER INC., Newark, DE (US)

(72) Inventor: David Rowntree, Durham (GB)

(73) Assignee: BLACK & DECKER INC., New Britain, CT (US)

( * ) Notice: Subject to any disclaimer, the term of this patent is extended or adjusted under 35 U.S.C. 154(b) by 430 days.

(21) Appl. No.: 14/681,182

(22) Filed: Apr. 8, 2015

(65) Prior Publication Data

US 2015/0289733 A1 Oct. 15, 2015

(30) Foreign Application Priority Data

Apr. 11, 2014 (EP) ..... 14164485

(51) Int. Cl.

| | |
|---|---|
| ***A47L 5/22*** | (2006.01) |
| ***A47L 5/24*** | (2006.01) |
| ***A47L 5/28*** | (2006.01) |

(52) U.S. Cl.

CPC ..... *A47L 5/225* (2013.01); *A47L 5/24* (2013.01); *A47L 5/28* (2013.01)

(58) Field of Classification Search

None

See application file for complete search history.

(56) References Cited

U.S. PATENT DOCUMENTS

2002/0124344 A1* 9/2002 Nishikori ..... A47L 9/0081 15/351
2003/0019072 A1* 1/2003 Houghton ..... A47L 5/225 15/331
2007/0271724 A1 11/2007 Hakan et al.

FOREIGN PATENT DOCUMENTS

| | | |
|---|---|---|
| EP | 1279362 | 1/2003 |
| EP | 2012638 | 6/2013 |
| JP | H04 364822 | 12/1992 |
| WO | WO2007117197 | 10/2007 |

OTHER PUBLICATIONS

EP Communication dated Jul. 19, 2016, for EP Application No. 14164485.6.

* cited by examiner

*Primary Examiner* — Christopher M Koehler
*Assistant Examiner* — Brian Keller
(74) *Attorney, Agent, or Firm* — John Yun

(57) ABSTRACT

A vacuum cleaning appliance comprises a handheld vacuum cleaning device comprising a motor coupled to a fan for generating an air flow through a nozzle air inlet. It also comprises a support frame comprising: a cleaning head having a cleaning head air inlet; and an air outlet in fluid communication with the cleaning head air inlet, the air outlet configured to couple with the nozzle air inlet when the handheld vacuum cleaning device is secured to the support frame and to create an airflow path from the cleaning head air inlet to the nozzle air inlet. The air outlet is moveable with respect to the support frame into a first position in which the air outlet projects from the support frame when the handheld vacuum cleaning device is detached from the support frame.

14 Claims, 7 Drawing Sheets

VACUUM CLEANING APPLIANCE

CROSS-REFERENCE TO RELATED APPLICATIONS

This application claims priority to European Patent Application No. 14164485.6 filed Apr. 11, 2014. The entire contents of that application are expressly incorporated herein by reference.

FIELD OF THE INVENTION

The present invention relates to a vacuum cleaning appliance. In particular the present invention relates to a vacuum cleaning appliance comprising a handheld cleaning device and support frame therefore.

BACKGROUND OF THE INVENTION

Vacuum cleaners are well known for collecting dust and dirt. Typically, vacuum cleaners are intended for use in a domestic environment, although they also find uses in other environments. Generally vacuum cleaners are electrically powered and comprise an electric motor and a fan connected to an output shaft of the motor, an inlet for dirty air, an outlet for clean air and a collection chamber for dust. Electrical power can be provided by a source of mains electricity or by a replaceable and/or rechargeable battery pack.

In recent times there has been a trend for vacuum cleaners to be battery operated because this removes the need for a power cable and allows the user to use the vacuum cleaner remote from sources of mains electricity. Battery operated vacuum cleaners are often smaller handheld devices which also assist in the portability of the vacuum cleaner. For example, a user can use a battery powered handheld vacuum cleaner in a vehicle well away from any sources of mains electricity.

A problem with the battery powered handheld vacuum cleaner is that the user typically also wants to clean floor surfaces. Cleaning floor surfaces with a handheld vacuum cleaner is tiresome because the handheld vacuum cleaner has smaller dimensions and the user may be forced to crouch down or stoop to engage the handheld vacuum cleaner with the floor surface.

It is known to use an extension with a handheld vacuum cleaner and EP1279362 shows such an arrangement. Another vacuum cleaning appliance is shown in EP2012638. EP2012638 discloses a handheld vacuum cleaner which can be used in conjunction with a stick frame. The stick frame comprises a handle and a cleaning head and the handheld vacuum cleaner can be attached thereto whilst being in fluid communication with the cleaning head. Once the handheld vacuum cleaner is attached to the stick frame, dirty air is drawn into the handheld vacuum cleaner via the cleaning head. The handle of the stick frame means that the handheld vacuum cleaner can be also used in a similar way to an upright vacuum cleaner.

A problem with EP2012638 and EP1279362 is that the handheld vacuum cleaner is hard to attach to the frame which can be frustrating for the user. Misalignment of the handheld vacuum cleaner with the stick frame means that the dirty air flow may not be properly drawn up from the cleaning head into the handheld device.

A vacuum cleaning appliance which is easier to use is desired. Embodiments of the present invention aim to address the aforementioned problems.

SUMMARY OF THE INVENTION

According to an aspect of the present invention there is a vacuum cleaning appliance comprising: a handheld vacuum cleaning device comprising a motor coupled to a fan for generating an air flow through a nozzle air inlet; and a support frame comprising: a cleaning head having a cleaning head air inlet; and an air outlet in fluid communication with the cleaning head air inlet, the air outlet configured to couple with the nozzle air inlet when the handheld vacuum cleaning device is secured to the support frame and to create an airflow path from the cleaning head air inlet to the nozzle air inlet; wherein the air outlet is moveable with respect to the support frame into a first position in which the air outlet projects from the support frame when the handheld vacuum cleaning device is detached from the support frame.

This means that when the air outlet in the first position it is free from obstructions such as the support frame. This makes sighting and physically aligning and coupling the nozzle air inlet and the air outlet easier. For example the handheld vacuum cleaning device is less likely to snag on the support frame.

Preferably the air outlet is pivotable with respect to the support frame. This means the air outlet can be easily deployed and retracted. Preferably the air outlet is resiliently biased into the first position. This means the air outlet is automatically deployed and the user does not need to manually fold out the air outlet before inserting the handheld vacuum cleaning device in the support frame.

Preferably the vacuum cleaning appliance comprises a latch mechanism for detachably securing the handheld vacuum cleaning device thereto. This means that the user must positively disengage the handheld vacuum cleaning device from the support frame. This prevents the handheld vacuum cleaning device being accidentally knocked out of the support frame.

Preferably the air outlet is moveable between the first position and a second position in which the air outlet is adjacent to the support frame when the handheld vacuum cleaning device is attached to the support frame. Preferably the support frame comprises a recess for receiving the handheld vacuum cleaning device. Preferably the air outlet is located at least partially within the recess. This means the air outlet is retracted within the support frame during operation and saves space.

Preferably when the handheld vacuum is detached, the air outlet projects beyond the recess. In this way the air outlet is even more remote from the support frame and makes coupling the nozzle air inlet and the air outlet easier.

Preferably the nozzle air inlet comprises a sleeve and the sleeve is slidable over the outside of air outlet. Preferably the air outlet comprises a stop member for engaging with the sleeve. Preferably the stop member comprises a substantially circumferential flange around the outside surface of the air outlet. This helps the user know when the air outlet is fully engaged with the nozzle air inlet.

Preferably the air outlet comprises a shoulder portion for engaging with a wall of the support frame when the air outlet is in the first position. In this way the movement of the air outlet is limited and prevented from pivoting too much and prevents accidental damage to the air outlet.

Preferably the air outlet comprises a substantially circumferential rib for engaging an inside surface of the nozzle air outlet. This improves the coupling between the support frame and the nozzle and reduces the amount of dirty air escaping.

Preferably the support frame comprises a duct providing an air flow path between the cleaning head air inlet and the air outlet, and the air outlet is coupled to the duct by virtue of a flexible air tight collar. The flexible collar permits the movement of the air outlet without letting the dirty air escape.

In another aspect of the present invention there is a support frame for a handheld vacuum cleaning device having a motor coupled to a fan for generating an air flow through a nozzle having a nozzle air inlet, the support frame comprising: a cleaning head having a cleaning head air inlet; and an air outlet in fluid communication with the cleaning head air inlet, the air outlet configured to couple with the nozzle air inlet when the handheld vacuum cleaning device is secured to the support frame and to create an airflow path from the cleaning head air inlet to the nozzle air inlet; wherein the air outlet is moveable with respect to the support frame into a first position in which the air outlet projects from the support frame when the handheld vacuum cleaning device is detached from the support frame.

BRIEF DESCRIPTION OF THE DRAWINGS

Various other aspects and further embodiments are also described in the following detailed description and in the attached claims with reference to the accompanying drawings, in which:

DETAILED DESCRIPTION OF THE INVENTION

Figure 1:
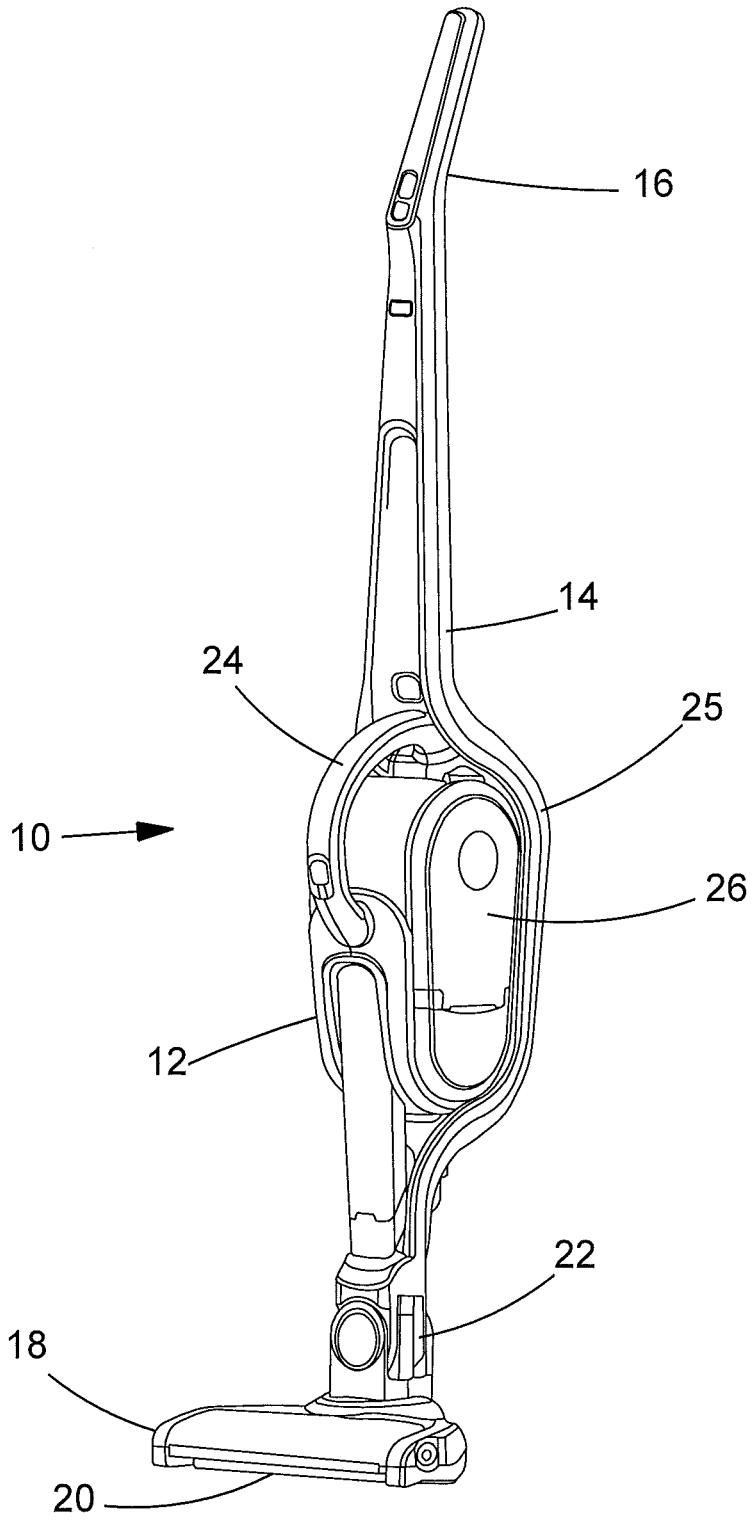
FIG. 1 shows a perspective view of the vacuum cleaning appliance.

FIG. 1 shows a perspective view of a vacuum cleaning appliance 10. The vacuum cleaning appliance comprises a handheld vacuum cleaning device 12 and a support frame 14. Hereinafter "handheld device" refers to the handheld vacuum cleaning device 12. At a first end the support frame 14 comprises a handle 16 with one or more controls for operating the vacuum cleaning appliance 10. At a second end the support frame 14 comprises a cleaning head 18. The cleaning head 18 comprises a cleaning head air inlet 20 for receiving dirty air from a surface. The cleaning head air inlet 20 is adjacent to the surface to be cleaned and extends on the underside of the cleaning head 18. The underside of the cleaning head 18 is the adjacent side of the cleaning head 18 to the surface to be cleaned. In some embodiments the cleaning head 18 is configured to engage a floor, but the cleaning head can engage any suitable surface such as walls, ceilings or e.g. upholstery. The cleaning head 18 is coupled to the rest of the support frame 14 via a universal joint 22. The universal joint 22 comprises two pivoting joints which are substantially perpendicular to each other. This allows the cleaning head 18 to move in at least two degrees of freedom with respect to the rest of the support frame 14. In this way the handle 16 and the handheld device 12 can move from side to side and forwards and backwards with respect to the cleaning head 18.

Figure 2:
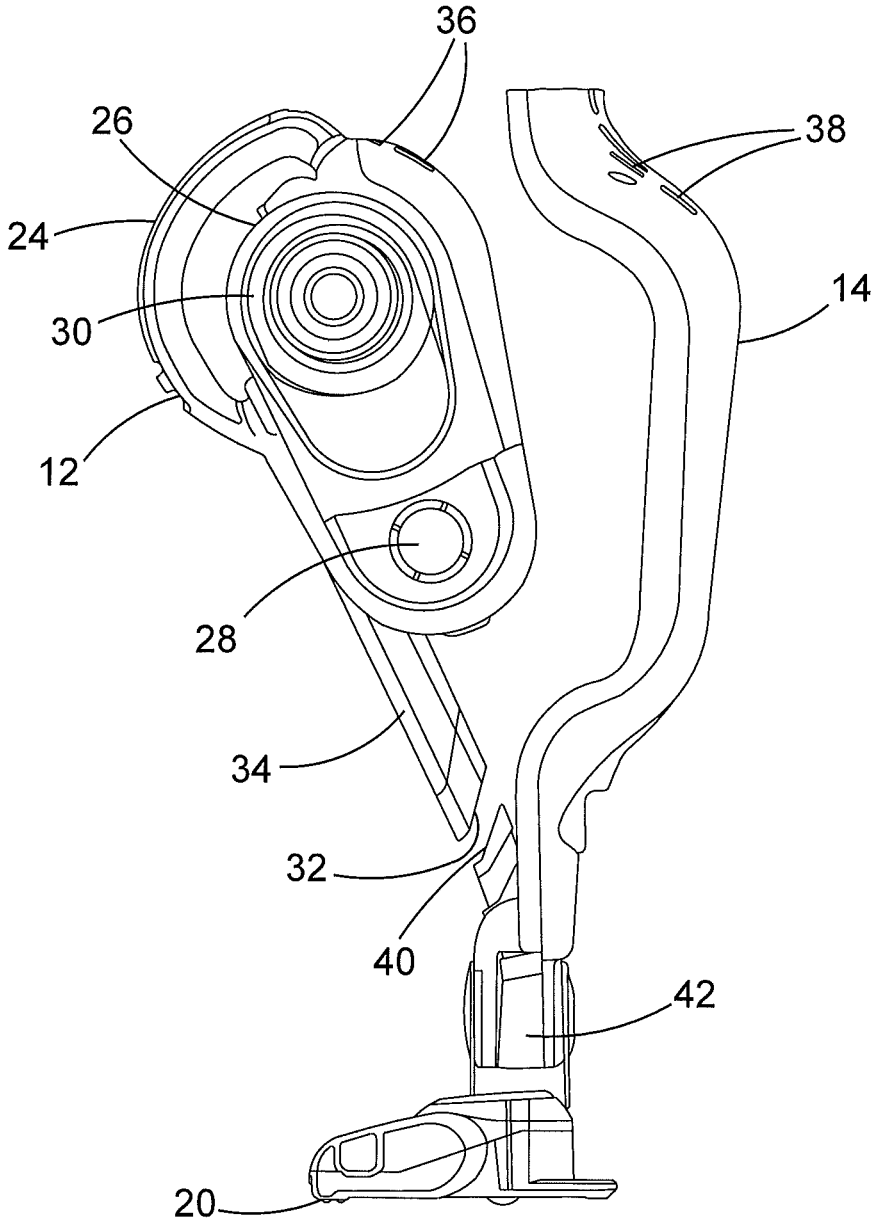
FIG. 2 shows a side view of the vacuum cleaning appliance.

Turning to FIG. 2, the handheld device 12 will be discussed in further detail. FIG. 2 shows a partial side view of the support frame 14 and the handheld device 12 detached from each other. The handheld device 12 comprises a handle 24 so that the user can use the handheld device 12 independently of the support frame 14. The handheld device 12 comprises a housing 26 comprising a motor and fan assembly 28 and dust container 30. In operation the motor and fan assembly 28 is configured to create an airflow and draw air into the housing 26 via a nozzle air inlet 32 in a nozzle 34.

Clean exhaust air is outputted from the handheld device 12 via exhaust holes 36 in the housing 26. Exhaust holes 36 are aligned with exhaust holes 38 in the support frame 14 when the handheld device 12 is coupled to the support frame 14. This means that when the handheld device 12 is attached to the support frame 14, the air is outputted from the back of the cleaning appliance 10 and directed away from the surface. This means that the clean exhaust air does not blow away the dirt and dust on the surface.

The handheld device 12 is releasably detachable from the support frame 14 and FIG. 2 shows the handheld device 12 about to be coupled with the support frame 14.

Figure 4:
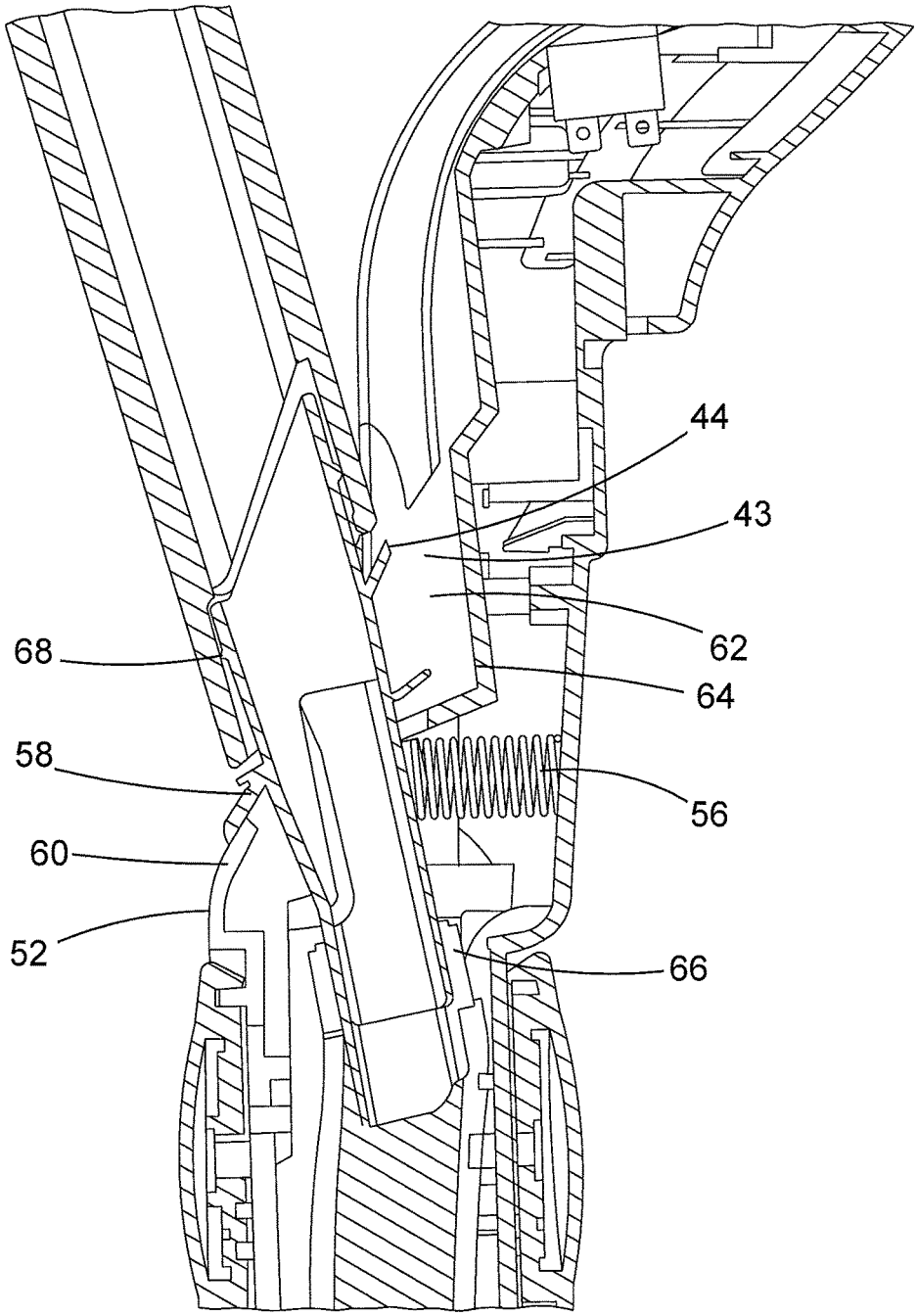
FIG. 4 shows a partial cross sectional view of the vacuum cleaning appliance.

The support frame 14 comprises an air outlet 40 which is in fluid communication with the cleaning head air inlet 20 via air duct 42. The air outlet 40 is coupled to the air duct via a collar 66 (as shown in FIG. 4) The collar 66 is tightly fixed to the air outlet 40 and the air duct 42 and provides an air tight seal therebetween. The air outlet 40 as shown in FIG. 2 projects from the support frame 14. In the first position, the air outlet 40 extends or projects beyond the side walls 25 of the support frame 14. The air outlet 40 is configured to move and is shown in a first position in FIG. 2. In the first position the air outlet 40 is approximately inclined by about 10 to 20 degrees from the longitudinal axis of the support frame 14.

Figure 3:
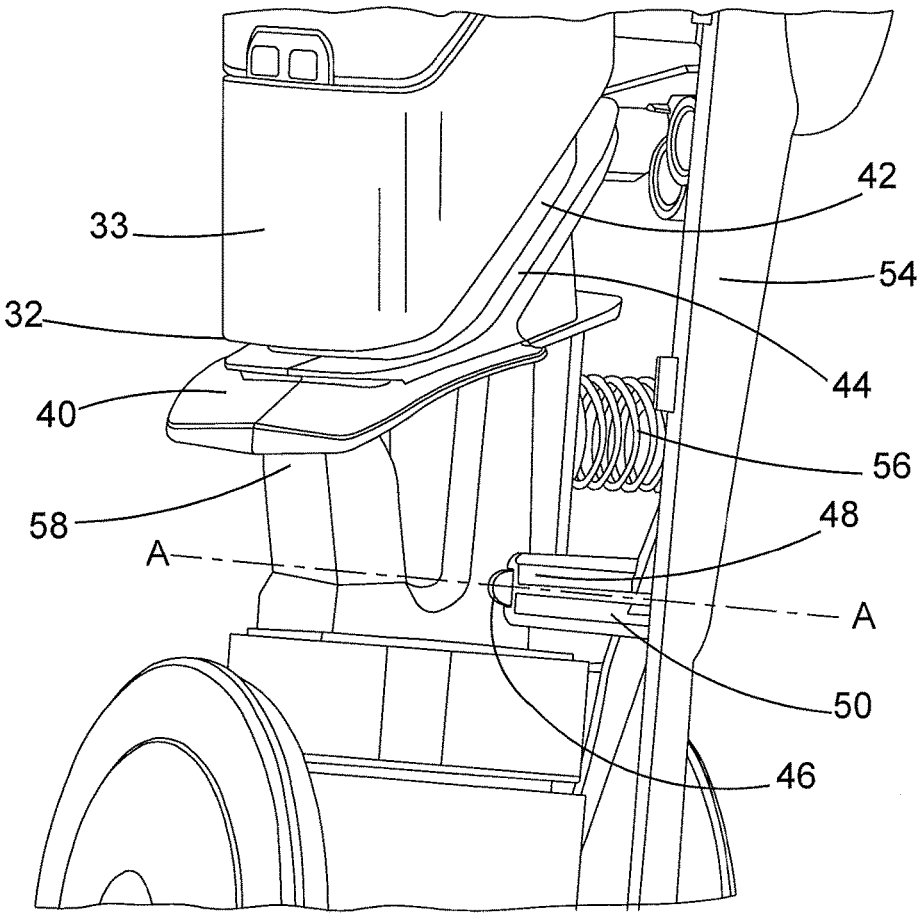
FIG. 3 shows a partial perspective close up view of the vacuum cleaning appliance.

When the user places the handheld device 12 in the support frame 14, the nozzle air inlet 32 engages with the air outlet 40. This will be discussed in further detail with respect to FIG. 3. FIG. 3 shows a close up partial perspective view of the vacuum cleaning appliance 10 when the nozzle air inlet 32 couples with the air outlet 40. The support frame 14 comprises a front housing portion 52 and a rear housing portion 54 which are fixed together. For the purposes of clarity, a front portion 52 (shown in FIG. 4) of the support frame 14 has been removed.

The air outlet 40 comprises a reciprocal cross-sectional shape to the nozzle air inlet 32. The cross sectional shape of the air outlet 40 and the nozzle air inlet 32 is rectangular, but the cross sectional shape may be circular or elliptical or any other suitable shape. The cross sectional external shape of the air outlet 40 is slightly smaller than the cross sectional internal shape of the nozzle air inlet 32. In this way the air outlet 40 is configured to fit snugly inside the nozzle air inlet 32. An end portion of a sleeve 33 of the nozzle air inlet 32 slides onto the air outlet 40 until the sleeve 33 abuts against a stop member 44. The stop member is a flange which projects circumferentially around the air outlet 40. However in other embodiments the stop member 44 can be protruding ribs, pegs or any means suitable for limiting the extent that the sleeve 33 can slide over the air outlet 40.

As mentioned above, the air outlet 40 is moveable between a first position in which the air outlet 40 is upstanding from the support frame 14 and a second position in which the air outlet is retracted adjacent to the support frame 14. In some embodiments, the air outlet 40 is pivotable between the first and second positions about an axis A. Of course in other embodiments the air outlet does not pivot but may slide or slide and pivot into a position whereby the air outlet 40 protrudes from the support frame 14.

When the air outlet 40 projects from the support frame 14, the air outlet 40 is clear of the support frame 14. This provides a free space 43 between the air outlet 40 and the support frame 14. This means that the handheld device 12 does not interfere with the support frame 14 when being coupled together. Furthermore the handheld device 12 does not obscure the user's view of the air outlet 40. This makes the nozzle air inlet 32 easier to align with the air outlet 40.

The air outlet 40 comprises pegs 46 (of which only one is visible) which are located in circular recesses 48 in a protruding arm 50 of the rear housing portion 54 of the support frame 14. The pegs 46 and the circular recesses 48 are aligned with axis A. FIG. 3 only shows the rear housing portion 54 of the support frame 14 but when both the front and rear housing portions 52, 54 of the support frame 14 are joined together, the circular recesses 48 in the support frame 14, constrain the movement of the air outlet 40 about the axis A.

The air outlet 40 is resiliently biased from the second position to the first position by a coiled spring 56. In other embodiments the air outlet 40 may be biased by any suitable means such as an elastomeric element or a leaf spring. This means that when the user removes the handheld device 12 from the support frame 14, the air outlet 40 will automatically move away from the support frame 14. In some other embodiments, the spring is optional. In this case the user may manually pull out the air outlet 40 before coupling the nozzle air inlet 32 with the air outlet 40.

The movement of the air outlet 40 is also described with reference to FIG. 4. FIG. 4 shows a partial cross sectional view of the vacuum cleaning appliance around the vicinity of the air outlet 40. The air outlet 40 comprises a shoulder portion 58 which abuts against a first wall 60 of the first housing portion 52 of the support frame 14 when the air outlet 40 is in the first position. The support frame 14 comprises two protruding walls 25 which define a recess 62 for receiving handheld device 12 and also the nozzle 34 when the nozzle 34 is coupled to the air outlet 40. In the second position the air outlet 40 abuts adjacent to an inner wall 64 of the recess. The recess 62 is reciprocal shape to the nozzle 34 and the air outlet 40.

In some embodiments there is a circumferential rib 68 on the external surface of the air outlet 40. The circumferential rib 68 engages with the internal surface of the nozzle air inlet 32 and provides a friction fit there between. In some embodiments (although not shown) the circumferential rib 68 engages with a reciprocal detent on the internal surface of the nozzle air inlet 32.

Figure 6:
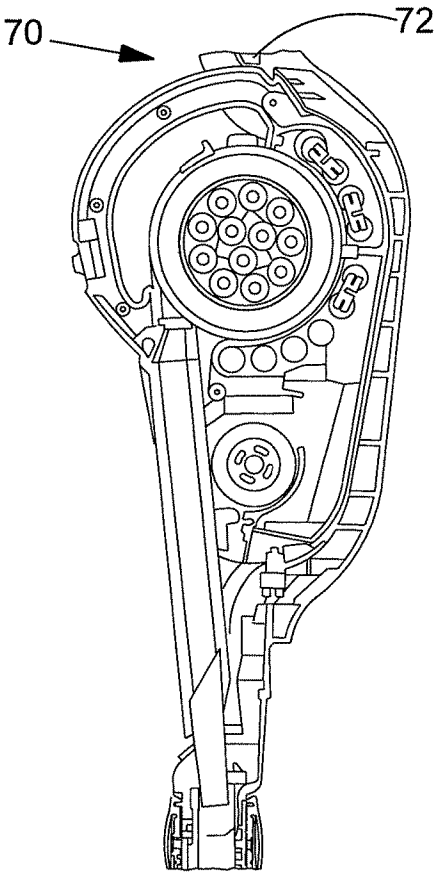
FIGS. 5 and 6 show additional partial cross sectional views of the vacuum cleaning appliance.
Figure 5:
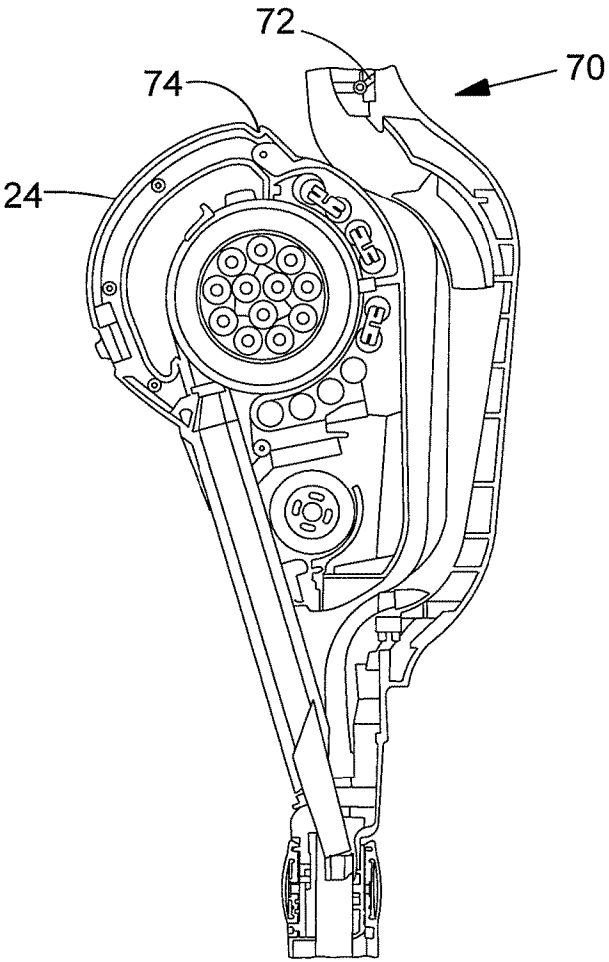

Once the nozzle air inlet 32 is coupled to the air outlet 40, the handheld device 12 is positively engaged with an optional latch mechanism 70. This will be discussed in further detail with respect to FIGS. 5 and 6. FIGS. 5 and 6 show a partial cross sectional drawings of the handheld device 12 respectively detached and attached to the support frame 14. The latch mechanism 70 comprises a sprung biased catch 72 mounted in the support frame 14. The catch 72 is configured to snap lock into a latch recess 74 located in the housing of the handheld 12 under the handle 24. The latch mechanism 70 is released with a push button (not shown). The latch mechanism secures the handheld device 12 into the support frame 14. Since the handheld device 12 is secured by the latch mechanism 70 and the coupling of the nozzle air inlet 32 and the air outlet 40, the handheld device is prevented from moving along the longitudinal axis of the support frame. Upstanding walls 25 of the support frame prevent the handheld device 12 from moving sideways with respect to the support frame 14 when the handheld device 12 is coupled to the support frame 14. In some alternative embodiments there is no latch mechanism and instead the handheld device 12 is coupled to the support frame by another means. For example the handheld device 12 can be held in the support frame 14 with a snug frictional fit.

Figure 7:
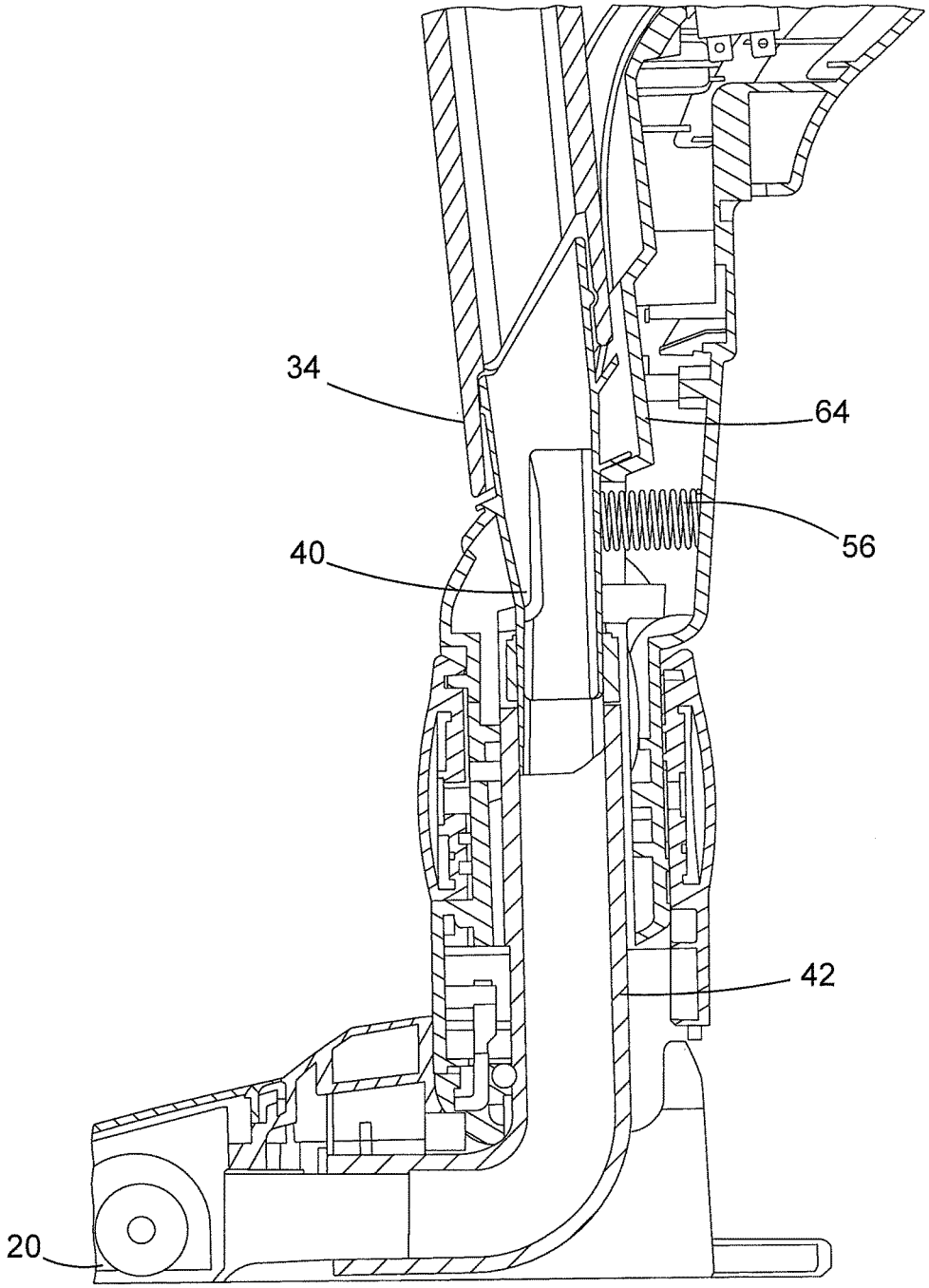
FIG. 7 shows another partial cross sectional view of the vacuum cleaning appliance.

FIG. 7 shows a partial cross sectional view of the air outlet 40 when the handheld device 12 is attached to the support frame 14. The air outlet 40 and the nozzle 34 are adjacent to the inner wall 64 of the recess 62. In this way the longitudinal axis of the air outlet 40 is substantially parallel with the longitudinal axis of the support frame 14. In use dirty air will be drawn up from the cleaning head air inlet 20 via the duct 42 and the air outlet 40 and into the nozzle 34 of the handheld device 12.

When the handheld device 12 is released from the support frame 14, the spring 56 urges the air outlet 40 into the first position. The air outlet 40 is then ready for the user to reattach the handheld device 12 to the support frame as previously discussed.

Figure 8:
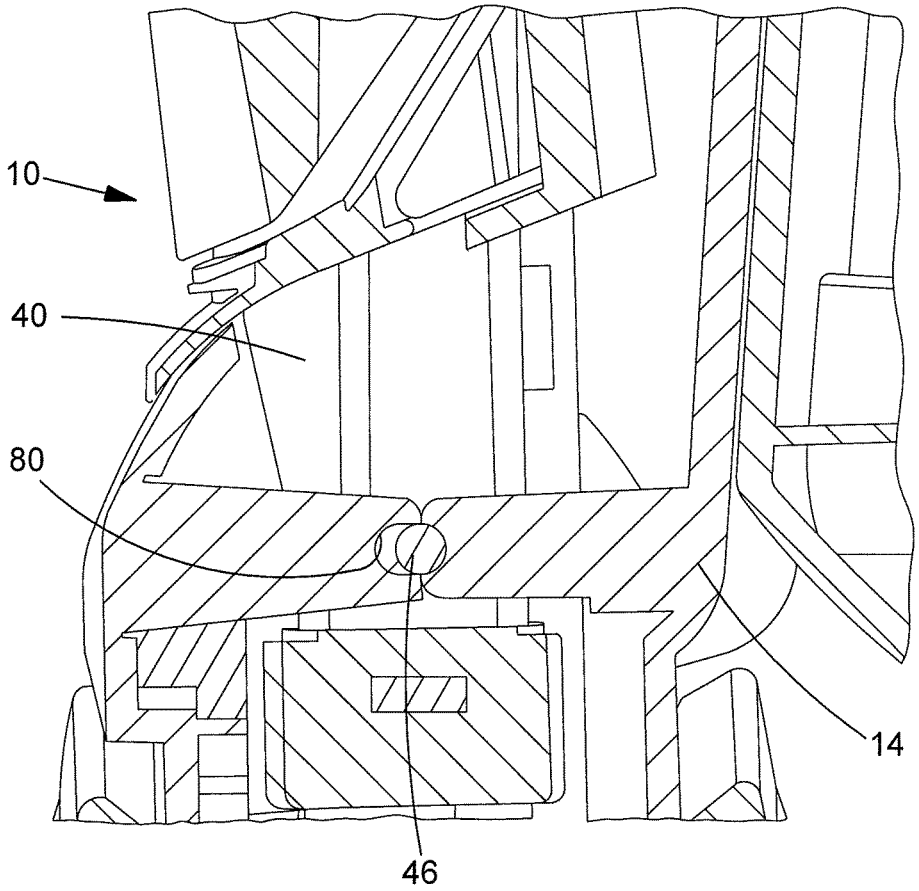
FIG. 8 shows another partial cross sectional view of the vacuum cleaning appliance.

FIG. 8 shows a partial cross section of another embodiment of the vacuum cleaning appliance 10. All the features of the vacuum cleaning appliance are the same as the described in reference to the previous embodiments above except that the air outlet 40 is slidably and pivotally mounted in the support frame 14. The pegs 46 are mounted in slots 80. The slots 80 extend along an axis substantially perpendicular to the longitudinal axis of the air outlet 40. Of course, the slots 80 can be any orientation. This means that the air outlet 40 can slide in the slot away from the support frame 14. By sliding away from the support frame 14, the air outlet 40 is more remote from the support frame 14 and this makes assembling the vacuum cleaning device 12 on the support frame 14 easier. The spring 56 effects both the pivoting and sliding motion of the air outlet 40. In addition the air outlet 40 can also pivot and this function has been previously discussed in reference to the previous embodiments. In other embodiments the slot may take any shape e.g. a curve or other irregular path to define movement of the air outlet 40 with respect to the support frame.

In another embodiment two or more embodiments are combined. Features of one embodiment can be combined with features of other embodiments.

Embodiments of the present invention have been discussed with particular reference to the examples illustrated. However it will be appreciated that variations and modifications may be made to the examples described within the scope of the invention.

The invention claimed is:

1. A vacuum cleaning appliance comprising:

a handheld vacuum cleaning device comprising a nozzle air inlet and a motor coupled to a fan for generating an air flow through the nozzle air inlet; and a support frame comprising:

a cleaning head having a cleaning head air inlet;

an air outlet in fluid communication with the cleaning head air inlet, the air outlet configured to couple with the nozzle air inlet when the handheld vacuum cleaning device is secured to the support frame and to create an airflow path from the cleaning head air inlet to the nozzle air inlet;

wherein the air outlet is moveable with respect to the support frame into a first position in which the air outlet projects from the support frame when the handheld vacuum cleaning device is detached from the support frame; and wherein the air outlet is resiliently biased into the first position.

2. The vacuum cleaning appliance according to claim 1 wherein the air outlet is pivotable with respect to the support frame.

3. The vacuum cleaning appliance according to claim 1 wherein the support frame comprises a latch mechanism for detachably securing the handheld vacuum cleaning device thereto.

4. The vacuum cleaning appliance according to claim 1 wherein the air outlet is moveable between the first position and a second position in which the air outlet is adjacent to the support frame when the handheld vacuum cleaning device is attached to the support frame.

5. The vacuum cleaning appliance according to claim 1 wherein the support frame comprises a recess for receiving the handheld vacuum cleaning device.

6. The vacuum cleaning appliance according to claim 5 wherein the air outlet is located at least partially within the recess.

7. The vacuum cleaning appliance according to claim 6 wherein when the handheld vacuum is detached, the air outlet projects beyond the recess.

8. The vacuum cleaning appliance according to claim 1 wherein the nozzle air inlet comprises a sleeve and the sleeve is slidable over the outside of air outlet.

9. The vacuum cleaning appliance according to claim 8 wherein the air outlet comprises a stop member for engaging with the sleeve.

10. The vacuum cleaning appliance according to claim 9 wherein the stop member comprises a substantially circumferential flange around an outside surface of the air outlet.

11. The vacuum cleaning appliance according to claim 1 wherein the air outlet comprises a shoulder portion for engaging with a wall of the support frame when the air outlet is in the first position.

12. The vacuum cleaning appliance according claim 1 wherein the air outlet comprises a substantially circumferential rib for engaging an inside surface of the nozzle air inlet.

13. The vacuum cleaning appliance according to claim 1 wherein the support frame comprises a duct providing an air flow path between the cleaning head air inlet and the air outlet, and the air outlet is coupled to the duct by virtue of a flexible air tight collar.

14. A support frame for a handheld vacuum cleaning device having a nozzle air inlet and a motor coupled to a fan for generating an air flow through the nozzle air inlet, the support frame comprising:

a cleaning head having a cleaning head air inlet for engaging with a floor; and an air outlet in fluid communication with the cleaning head air inlet, the air outlet configured to couple with the nozzle air inlet when the handheld vacuum cleaning device is secured to the support frame and to create an airflow path from the cleaning head air inlet to the nozzle air inlet;

wherein the air outlet is moveable with respect to the support frame into a first position in which the air outlet projects from the support frame when the handheld vacuum cleaning device is detached from the support frame; and wherein the air outlet is resiliently biased into the first position.

* * * * *